US009710983B2

(12) United States Patent
Asmar et al.

(10) Patent No.: US 9,710,983 B2
(45) Date of Patent: Jul. 18, 2017

(54) METHOD AND SYSTEM FOR AUTHENTICATING VEHICLE EQUIPPED WITH PASSIVE KEYLESS SYSTEM

(71) Applicant: GM GLOBAL TECHNOLOGY OPERATIONS LLC, Detroit, MI (US)

(72) Inventors: Ron Y. Asmar, West Bloomfield, MI (US); David T. Proefke, Troy, MI (US); Charles J. Bongiorno, Sterling Heights, MI (US); Aaron P. Creguer, Fenton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 147 days.

(21) Appl. No.: 14/608,720

(22) Filed: Jan. 29, 2015

(65) Prior Publication Data

US 2016/0225203 A1 Aug. 4, 2016

(51) Int. Cl.
*G07C 9/00* (2006.01)

(52) U.S. Cl.
CPC ..... *G07C 9/00309* (2013.01); *G07C 2009/00396* (2013.01); *G07C 2209/63* (2013.01)

(58) Field of Classification Search
None
See application file for complete search history.

(56) References Cited

U.S. PATENT DOCUMENTS 8,571,551 B1 * 10/2013 Bertz ..... H04W 60/04 455/435.1
2006/0082434 A1 * 4/2006 Brey ..... B60R 25/04 340/5.6
2007/0281689 A1 * 12/2007 Altman ..... G06Q 30/0207 455/435.1
2011/0068895 A1 * 3/2011 Gee ..... B60R 25/00 340/5.67
2013/0271273 A1 * 10/2013 Oesterling ..... G07C 9/00309 340/426.18
2014/0058632 A1 * 2/2014 Jungman ..... B60K 28/063 701/48
2014/0087655 A1 * 3/2014 Hall ..... H04B 5/0075 455/41.1
2014/0310186 A1 * 10/2014 Ricci ..... H04W 48/04 705/302
2014/0373661 A1 * 12/2014 Benson ..... F16H 61/18 74/473.21
2015/0145648 A1 * 5/2015 Winkelman ..... G07C 9/00309 340/5.72
2016/0283963 A1 * 9/2016 Zafiroglu ..... G06Q 30/0224

* cited by examiner

*Primary Examiner* — Laura Nguyen
(74) *Attorney, Agent, or Firm* — Reising Ethington, P.C.

(57) ABSTRACT

A system and method is provided for authenticating a vehicle equipped with a passive keyless system. The method includes sending one or more initial challenge signal(s) from a vehicle module to a portable keyfob in response to a passive keyless start attempt of the vehicle, the initial challenge signal(s) being sent before a successful passive keyless start of the vehicle; sending one or more secondary challenge signal(s) from the vehicle module to the portable keyfob in response to at least one trigger event and after a successful passive keyless start of the vehicle; initiating an active authentication to confirm the presence of an authorized driver in the vehicle if a valid response to the secondary challenge signal(s) is not received by the vehicle module; and performing one or more remedial action(s) if a valid response to the active authentication is not received.

19 Claims, 3 Drawing Sheets

METHOD AND SYSTEM FOR AUTHENTICATING VEHICLE EQUIPPED WITH PASSIVE KEYLESS SYSTEM

FIELD

The present invention relates generally to automobile key systems, and more particularly, to passive keyless entry and start systems.

BACKGROUND

Passive keyless (PK) systems include passive keyless entry and start (PKES) systems, passive keyless entry (PKE) systems (without passive start), as well as passive keyless start (PKS) systems that may not provide for passive entry. A PK system may include the use of a key or require other user action for either entry or vehicle start (ignition-on). The passive keyless entry and start (PKES) system generally includes a vehicle receiver, a vehicle transmitter and a portable keyfob, which is used to passively authorize a user and to carry out a vehicle function (e.g., door unlock). Alternatively, a single transceiver may be used in place of a separate receiver and transmitter. In general, PKES systems are configured to allow access and allow the vehicle to start as long as the portable keyfob is within a prescribed zone in proximity to or within the vehicle. Under normal operating conditions, passive authorization in PKES systems is initiated by an attempt to enter and/or start the vehicle. In some embodiments, the attempt is made by pressing a button on or near an exterior door handle and/or by touching, pulling or lifting a door handle; while in other embodiments, the PKES system automatically initiates the vehicle function when the presence of the keyfob is detected. In either case, passive authorization is accomplished by sending a random interrogation signal from a vehicle LF base-station to the keyfob. In response, the keyfob transmits a validating response signal to a vehicle receiver or transceiver. Due to the passive nature of authorization, PKES systems may be susceptible to wireless attacks, and in particular, to relay attacks.

In relay attacks, the vehicle may be unlocked and started when the portable keyfob is not within the required proximal zone of the vehicle. The use of relay signals trick the fob and vehicle into concluding that the portable keyfob, and hence the vehicle users, are within the prescribed proximity and thus performs the requested operation. Therefore, thieves may gain entry to the vehicle. FIG. 1 illustrates one example of a relay attack wherein a vehicle 1 is equipped with a PKES system having a vehicle receiver/transmitter (transceiver) 2; a portable keyfob 3 being carried by the vehicle's owner or other authorized user 4; and first and second thieves 5, 6. The first thief 5 may place a first repeater (FR) 7 near the target vehicle 1 and the second thief 6 may carry a secondary repeater (SR) 8. The repeater is a device that receives and retransmits the signal (i.e., relays the signal). It may contain a processor and a modem; thus, the received signal may be modulated prior to being retransmitted (e.g., to a different frequency, encoded, etc.). In addition, the repeaters 7, 8 may communicate wirelessly or by wire. In any case, the first thief 5 first acquires an interrogation signal from the vehicle 1. This may be accomplished by merely placing the FR 7 near the vehicle 1 in systems that periodically or continuously transmit an interrogation signal via the vehicle transceiver 2. In some systems, the interrogation signal is emitted by the transceiver 2 once a button is pressed on the vehicle door handle or the vehicle door handle is pulled or lifted. Upon acquisition of the interrogation signal, the FR 7 sends the signal to the SR 8. Provided the second thief 6 is close enough to the victim 4, the keyfob 3 will respond to the interrogation signal sent from the SR 8—being tricked into believing that the vehicle 1 must be nearby. The keyfob 3 sends a validating response signal which is in turn captured by the SR 8 and relayed to the FR 7, which in turn relays it to the vehicle 1 where it is received by the transceiver 2. The transceiver 2 then validates the response signal and unlocks the vehicle doors.

For some keyless systems, a similar process may be performed in order to start the vehicle 1. In some instances, the vehicle doors must first be closed before the vehicle 1 will send an interrogation signal via the transceiver 2; in some systems, a start button inside the vehicle 1 must be actuated first. Furthermore, in some PKES systems, there are multiple transmissions between the transceiver 2 and the keyfob 3 prior to unlocking the vehicle doors or starting the vehicle 1 (e.g., first a wake-up signal from the transceiver 2 and an acknowledgement signal from the keyfob 3; then an interrogation signal from the transceiver 2 and then a response signal from the keyfob 3). Also, while there is generally only one FR 7 required, thieves may use multiple SRs 8. The SR(s) 8 may be strategically positioned rather than carried by the thief 6 (e.g., near one or more entrances or hallways where the victim 4 is likely to walk after exiting the vehicle 1). In wireless repeater systems, the range of reception/transmission may vary depending upon such factors as design and environment. Regardless, the SR 8 typically needs to be relatively close to the victim's keyfob 3 (e.g., 1-3 meters away).

SUMMARY

According to one aspect, there is provided a method for authenticating a vehicle equipped with and a passive keyless system that includes a vehicle transceiver configured to communicate with a portable keyfob. The method may comprise the steps of: sending one or more initial challenge signal(s) from the vehicle transceiver to the portable keyfob in response to a passive keyless start attempt of the vehicle, the initial challenge signal(s) being sent before a successful passive keyless start of the vehicle; sending one or more secondary challenge signal(s) from the vehicle transceiver to the portable keyfob in response to a trigger event, the secondary challenge signal(s) being sent after a successful passive keyless start of the vehicle; initiating an active authentication to confirm the presence of an authorized driver in the vehicle when a valid response to the secondary challenge signal(s) is not received by the vehicle transceiver; and performing one or more remedial action(s) if a valid response to the active authentication is not received.

According to another aspect, there is provided a method for authenticating a vehicle equipped with and a passive keyless system that includes a vehicle transceiver configured to communicate with a portable keyfob. The method may comprise the steps of: initiating passive authentication of the keyfob following a passive keyless start of the vehicle and in response to a trigger event; determining if an authorized driver is present in the vehicle when a predetermined number of attempts to passively authenticate the keyfob have failed, wherein determining if an authorized driver is present includes sending one or more prompt(s) requiring a valid active-response from an authorized driver and/or an authorized wireless device; and performing one or more remedial action(s) if a valid active-response is not received.

According to yet another aspect, there is provided a system for authenticating an authorized driver of a vehicle. The system may comprise: at least one vehicle system module configured to detect one or more moving vehicle trigger(s); and a passive keyless start system including a vehicle transceiver configured to wirelessly communicate with, and to passively authenticate, a transceiver of a portable keyfob in response to detecting at least one of the moving vehicle triggers. The passive keyless start system is configured to: determine if an authorized driver is present in the vehicle when a predetermined number of attempts to passively authenticate the keyfob have failed, wherein determining the presence of the authorized driver includes sending one or more prompt(s) requiring a valid active-response from an authorized driver and/or an authorized wireless device; and initiate one or more remedial action(s) in response to determining that no authorized driver is present.

DRAWINGS

One or more preferred exemplary embodiments of the invention will hereinafter be described in conjunction with the appended drawings, wherein like designations denote like elements, and wherein.

DESCRIPTION

The system and method described below pertain to vehicles equipped with passive keyless (PK) systems, and more specifically, to authenticating an authorized driver and providing remedial actions when a driver cannot be authenticated. The present system and method may be used to identify and/or thwart relay type attacks, such as that previously described.

Communications System—

Figure 2:
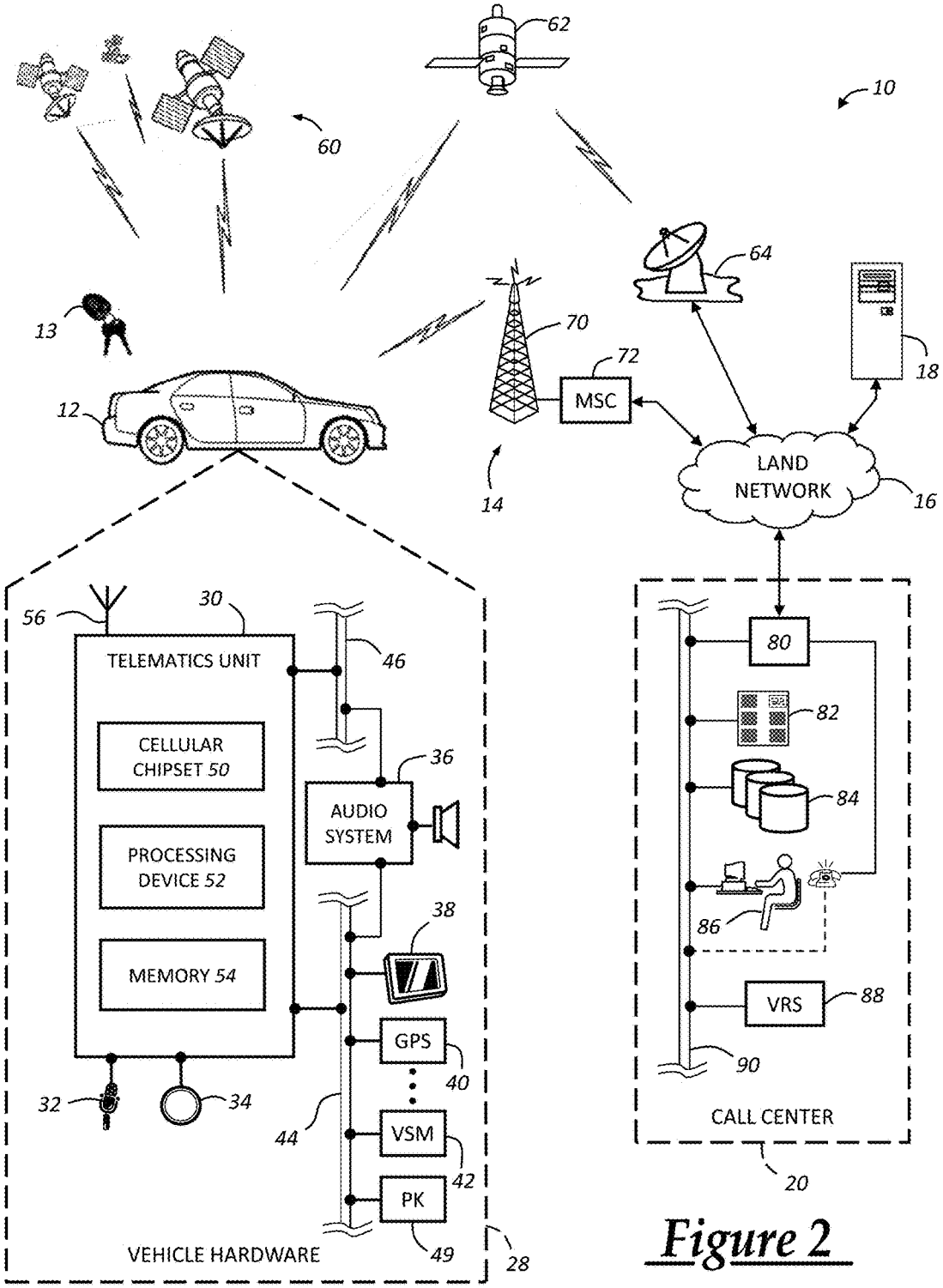
FIG. 2 is a block diagram depicting an exemplary embodiment of a communications system that is capable of utilizing the method disclosed herein.

With reference to FIG. 2, there is shown an exemplary operating environment that comprises a mobile vehicle communications system 10 that can be used to implement the method disclosed herein. Communications system 10 generally includes a vehicle 12, one or more wireless carrier systems 14, a land communications network 16, a computer 18, and a call center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such exemplary system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, aircraft, etc., can also be used. The vehicle 12 includes an electronic vehicle key or portable keyfob 13 and may include pushbutton keyless-start technology (e.g., rather than requiring insertion of the key into an ignition switch). In the illustrated embodiment, keyfob 13 includes a remote transmitter which communicates with a base unit installed in the vehicle 12 to provide the vehicle operator with localized wireless access to various vehicle functions such as locking and unlocking doors, arming and disarming of a vehicle alarm system, trunk release, panic signaling, and engine starting. The keyfob 13 may include buttons for these various features so that, for example, by depressing the panic button on the keyfob, the transmitter signals the vehicle to sound a high decibel alarm that can be heard for some distance. As used herein, the term "keyfob" refers to any portable vehicle access device that enables access to the vehicle interior or trunk, initiates vehicle engine operation, electric motor operation or some other device that provides vehicle propulsion, or both. The term "keyfob" includes passive or active transmitters that can be attached to keys by a loop or tether, as well as other portable remote transmitters regardless of whether they are attached to keys, as well as remote transmitters that are integrated together with a vehicle key or other device as a single component. The keyfob and its associated base unit on the vehicle may be conventional components that are well known to those skilled in the art. The keyfob may also exist in the form of a smartphone, wearable electronic device, or other such device.

In addition to the keyfob 13, some of the other vehicle hardware 28 are shown generally in FIG. 2 and include a telematics unit 30, a microphone 32, one or more pushbuttons or other control inputs 34, an audio system 36, a visual display 38, and a GPS module 40 as well as a number of vehicle system modules (VSMs) 42. Some of these devices can be connected directly to the telematics unit 30 such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 can be an OEM-installed (embedded) or an aftermarket device that enables wireless voice and/or data communication over wireless carrier system 14 and via wireless networking so that the vehicle can communicate with call center 20, other telematics-enabled vehicles, or some other entity or device. The telematics unit 30 preferably uses radio transmissions to establish a communications channel (a voice channel and/or a data channel) with wireless carrier system 14 so that voice and/or data transmissions can be sent and received over the channel. By providing both voice and data communication, telematics unit 30 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor or voice response unit at the call center 20) and data communication (e.g., to provide GPS location data or vehicle diagnostic data to the call center 20), the system can utilize a single call over a voice channel and switch as needed between voice and data transmission over the voice channel, and this can be done using techniques known to those skilled in the art.

According to one embodiment, telematics unit 30 utilizes cellular communication according to either GSM or CDMA standards and thus includes a standard cellular chipset 50 for voice communications like hands-free calling, a wireless modem for data transmission, an electronic processing device 52, one or more digital memory devices 54, and a dual antenna 56. It should be appreciated that the modem can either be implemented through software that is stored in the telematics unit 30 and is executed by processor 52, or it can be a separate hardware component located internal or external to telematics unit 30. The modem can operate using any number of different standards or protocols such as EVDO, CDMA, GPRS, and EDGE. Wireless networking between the vehicle and other networked devices can also be carried out using telematics unit 30. For this purpose, telematics unit 30 can be configured to communicate wirelessly according to one or more wireless protocols, such as any of the IEEE 802.11 protocols, WiMAX, or Bluetooth. When used for packet-switched data communication such as TCP/IP, the telematics unit 30 can be configured with a static IP address or can set up to automatically receive an assigned IP address from another device on the network such as a router or from a network address server.

Processor 52 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Processor 52 executes various types of digitally-stored instructions, such as software or firmware programs stored in memory 54, which enable the telematics unit 30 to provide a wide variety of services. For instance, processor 52 can execute programs or process data to carry out at least a part of the method discussed herein.

Telematics unit 30 can be used to provide a diverse range of vehicle services that involve wireless communication to and/or from the vehicle. Such services include: turn-by-turn directions and other navigation-related services that are provided in conjunction with the GPS-based vehicle navigation module 40; airbag deployment notification and other emergency or roadside assistance-related services that are provided in connection with one or more collision sensor interface modules such as a body control module (not shown); diagnostic reporting using one or more diagnostic modules; and infotainment-related services where music, webpages, movies, television programs, videogames and/or other information is downloaded by an infotainment module (not shown) and is stored for current or later playback. The above-listed services are by no means an exhaustive list of all of the capabilities of telematics unit 30, but are simply an enumeration of some of the services that the telematics unit is capable of offering. Furthermore, it should be understood that at least some of the aforementioned modules could be implemented in the form of software instructions saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit 30.

GPS module 40 receives radio signals from a constellation 60 of GPS satellites. From these signals, the module 40 can determine vehicle position that is used for providing navigation and other position-related services to the vehicle driver. Navigation information can be presented on the display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to call center 20 or other remote computer system, such as computer 18, for other purposes, such as fleet management. Also, new or updated map data can be downloaded to the GPS module 40 from the call center 20 via the telematics unit 30. The GPS module 40 may also be used to determine vehicle movement, speed, and/or velocity. Speed and velocity are merely functions of changes in distance versus changes in time (whereas velocity further indicates direction).

Apart from the audio system 36 and GPS module 40, the vehicle 12 can include other vehicle system modules (VSMs) 42 in the form of electronic hardware components that are located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to the telematics unit 30, and can be programmed to run vehicle system and subsystem diagnostic tests. As examples, one VSM 42 can be an engine control module (ECM) that controls various aspects of engine operation such as fuel injector and ignition timing, another VSM 42 can be a hybrid control module (HCM) that regulates operation of one or more components of the vehicle powertrain and determines whether they are currently operative (e.g., determines alternative propulsion states or mechanisms), and another VSM 42 can be a body control module (BCM) that governs various electrical components located throughout the vehicle, like the vehicle's power door locks and headlights. As is appreciated by those skilled in the art, the above-mentioned VSMs are only examples of some of the modules that may be used in vehicle 12, as numerous others are also possible.

According to one embodiment, the BCM and/or other VSMs 42 may detect one or more vehicle entrance indicators. Vehicle entrance indicators may include vehicle sensor inputs of any activity indicative of vehicle ingress such as the actuation of a door handle, whether a vehicle door is open or closed, whether a seat buckle or passenger restraint is fastened or secured, the depression of a brake pedal and/or of a clutch pedal, the actuation of a vehicle start button, and/or the engagement of a transmission (e.g., shifting the vehicle 12 into DRIVE or REVERSE). In addition, the vehicle 12 may be equipped with passive keyless antennas located inside of and/or outside of the passenger compartment that are used to detect the presence of the vehicle key or the keyfob used to start the vehicle. At least one keyfob antenna may be located in the passenger compartment near the driver. Other keyfob antennas may be near the vehicle doors or the rear of the vehicle (e.g., near the trunk) to detect the presence of the key or keyfob as it approaches the vehicle. In all cases, the keyfob antennas may be hidden from view (e.g., underneath paneling or the vehicle's body panels). This list is merely exemplary and not inclusive of all vehicle entrance indicators. The BCM or other VSM may determine vehicle ingress using one or more of these vehicle entrance indicators (e.g., using a combination, series, or sequence of vehicle entrance indicators).

The BCM may also determine vehicle movement using one or more sensor inputs. These sensor inputs may include one or more position sensors at one or more wheels or the transmission of the vehicle 12 (such as encoders, Hall-effect sensors, etc.). The sensor inputs to the BCM may also include vehicle accelerometer or gyroscopic data.

Vehicle hardware 28 also include a number of vehicle user interfaces that provide vehicle occupants with a means of providing and/or receiving information, including microphone 32, pushbuttons(s) 34, audio system 36, and visual display 38. As used herein, the term 'vehicle user interface' broadly includes any suitable form of electronic device, including both hardware and software components, which is located on the vehicle and enables a vehicle user to communicate with or through a component of the vehicle. Microphone 32 provides audio input to the telematics unit to enable the driver or other occupant to provide voice commands and carry out hands-free calling via the wireless carrier system 14. For this purpose, it can be connected to an on-board automated voice processing unit utilizing human-machine interface (HMI) technology known in the art. The pushbutton(s) 34 allow manual user input into the telematics unit 30 to initiate wireless telephone calls and provide other data, response, or control input. Separate pushbuttons can be used for initiating emergency calls versus regular service assistance calls to the call center 20. One such pushbutton 34 may be a vehicle start button that is part of a passive keyless system and may initiate a vehicle ignition sequence (e.g., internal combustion engines) or a vehicle start sequence (e.g., electric vehicles). Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM and satellite radio, CD, DVD and other multimedia functionality in addition to audible cues and warnings for notification to vehicle occupants. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions. Various other vehicle user interfaces can also be utilized, as the interfaces of FIG. 2 are only an example of one particular implementation.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000), LTE, or GSM/GPRS. As will be appreciated by those skilled in the art, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to call center 20. For example, land network 16 may include a public switched telephone network (PSTN) such as that used to provide hardwired telephony, packet-switched data communications, and the Internet infrastructure. One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, call center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 12 or call center 20, or both. A computer 18 can also be used for providing Internet connectivity such as DNS services or as a network address server that uses DHCP or other suitable protocol to assign an IP address to the vehicle 12.

Call center 20 is designed to provide the vehicle hardware 28 with a number of different system back-end functions and, according to the exemplary embodiment shown here, generally includes one or more switches 80, servers 82, databases 84, live advisors 86, as well as an automated voice response system (VRS) 88, all of which are known in the art. These various call center components are preferably coupled to one another via a wired or wireless local area network 90. Switch 80, which can be a private branch exchange (PBX) switch, routes incoming signals so that voice transmissions are usually sent to either the live adviser 86 by regular phone or to the automated voice response system 88 using VoIP. The live advisor phone can also use VoIP as indicated by the broken line in FIG. 2. VoIP and other data communication through the switch 80 is implemented via a modem (not shown) connected between the switch 80 and network 90. Data transmissions are passed via the modem to server 82 and/or database 84. Database 84 can store account information such as subscriber authentication information, vehicle identifiers, profile records, behavioral patterns, and other pertinent subscriber information. Data transmissions may also be conducted by wireless systems, such as 802.11x, GPRS, and the like. Although the illustrated embodiment has been described as it would be used in conjunction with a manned call center 20 using live advisor 86, it will be appreciated that the call center can instead utilize VRS 88 as an automated advisor or, a combination of VRS 88 and the live advisor 86 can be used.

Figure 3:
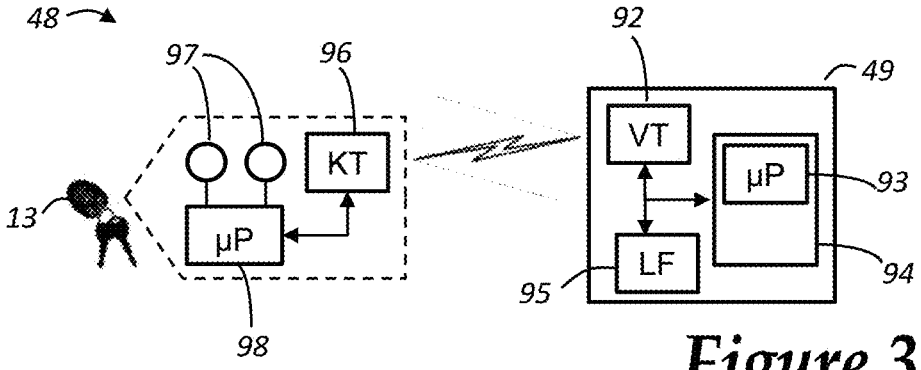
FIG. 3 is a block diagram of a passive keyless (PK) system that is included as part of the onboard vehicle electronics shown in FIG. 2.

With reference also to FIG. 3, the vehicle 12 may be equipped with a passive keyless (PK) system 48, which in the illustrated embodiment is shown as a passive keyless entry and start (PKES) system. The PK system may include keyfob 13 and an onboard (vehicle-installed) VSM or base unit module 49 that includes an LF base-station 95, a vehicle receiver or transceiver (VT) 92, a processor 93, associated electronics 94, as well as one or more optional keyfob locators, as indicated. Vehicles having PKES may automatically unlock and start the vehicle 12 based upon communications between the base unit 49 and the keyfob 13. The base unit 49 may transmit and receive signals to/from the keyfob 13 and may transmit at a suitable low frequency (e.g., 120-135 kHz with a range of up to approximately 10 meters) and transmit and/or receive a suitable ultra-high frequency (e.g., 315 or 433 MHz with a range of up to 400 meters). The processor 93 may execute instructions that provide at least some of the functionality for the keyfob 13. As used herein, the term instructions may include, for example, control logic, computer software and/or firmware, programmable instructions, or other suitable instructions. The processor may include, for example, one or more microprocessors, microcontrollers, application specific integrated circuits, programmable logic devices, and/or any other suitable type of processing device. In another embodiment, the processor may be in the vehicle telematics unit 30 or it may be the telematics unit 30 itself.

The keyfob 13 may comprise a radio frequency identification (RFID) tag or integrated circuit, an ultra-high frequency keyfob transmitter or transceiver (KT) 96, a user interface 97 (e.g., pushbuttons), and a processor 98. The RFID tag may be in the low frequency (e.g., 120-135 kHz) for shorter range communication (the tag may be excited at a range of 1-2 meters in an active mode or at a range of 2-10 centimeters in a passive mode). Active mode refers to the RFID tag being coupled to a power source (e.g., a battery in the keyfob) so that the RFID signal may be transmitted at any time. In contrast, RFID tags in the passive mode utilize no power source, and therefore are only responsive when excited by another power source—e.g., by induction. Often the other source may be the source attempting to read their RFID tag. Additionally, in some embodiments the RFID tag may be further integrated with microprocessors, transceivers, or both. Skilled artisans will appreciate that the term "passive keyless (PK) system" does not refer to the RFID passive mode of the previous sentence. The KT 96 may operate at a suitable high frequency (e.g., 315 or 433 MHz with a range of approximately several hundred meters), thus enabling longer range communication. The user interface may include buttons 97 for remote lock/unlock of the vehicle doors, remote trunk open, and a panic button. Furthermore, the keyfob 13 may also comprise a processor 98. In vehicles having keyfob antennas, the antennas may transmit a low frequency signal that is identifiable by the keyfob's low frequency RFID tag, preferably in the active mode. Thus, the keyfob by nature of its transmission to the vehicle, by nature of its transmission to the vehicle, may indicate when the keyfob 13 is within a certain range (e.g., 1-2 meters of one or more of these antennas)—and thereby, in concert with base unit 49, may determine whether the keyfob 13 is inside or outside of the vehicle 12. The keyfob's RFID tag, in combination with the keyfob's processor, may be equipped to measure the signal strength of the low frequency signals received, further enhancing the ability of the system to determine the keyfob's location in relation to the vehicle.

In some PKES systems 48, the system will unlock the vehicle door(s) when the user pulls the door handle with the keyfob 13 (e.g., carried by the vehicle user) in proximity of the vehicle 12. Starting of the vehicle in such systems may require a further user action, such as pressing a start button in the vehicle and providing a start command. This further user action may also involve a further confirmation of the continued presence of the keyfob. In other embodiments, the PKES system may both unlock and start the car automatically. Thus, the user may simply open the door and drive the vehicle because of his or her mere possession of the keyfob (i.e., without ever inserting the keyfob in a lock or ignition switch and/or without depressing the vehicle start button). In either approach, the vehicle is unlocked and started after a wireless communication occurs between the base unit 49 and the keyfob 13, which may be transparent to the vehicle user. For example, the base unit 49, through LF base-station 95 may transmit a continuous or periodic beacon or interrogation signal. The beacon signal may include a challenge or a query to validate the keyfob's identity. The beacon signal may further include a vehicle identification (ID). When the keyfob 13 receives the beacon signal, through the RFID tag, the processor 98 may wake-up, interpret the signal, and compute a valid response signal which may then be transmitted via the KT 96 to VT 92. Upon receiving a properly validated response, the BCM or other VSM 49 may instruct the vehicle 12 to unlock the vehicle door(s) and/or start the vehicle motor. In other PKES systems, the beacon signal of the LF base-station 95 may only be a wake-up signal. When the keyfob 13 receives the wake-up signal, it may demodulate the wake-up signal, interpret it, compute, and transmit an acknowledge signal. Then, once the VT 92 receives the acknowledge signal, the VT may transmit another beacon signal having the vehicle ID and/or challenge signal to test the response from the keyfob 13. In still other PKES systems 48, the vehicle doors will not unlock nor will the vehicle start without an additional vehicle user action. For example, the LF base-station 95 may not transmit any beacon signal until the user actuates the vehicle door handle. Only then may the LF base-station 95 and keyfob 13 wirelessly communicate. Similarly, the keyless start functionality may require additional vehicle user action: e.g., the LF base-station 95 may not transmit any beacon signal until the keyfob enters the vehicle (determined, e.g., using the door status information); the user actuates the vehicle start button; the user depresses the vehicle brake pedal; and/or the user performs some other operation associated with entry to the vehicle 12, to cite several possibilities.

It should be appreciated that all communications between the LF base-station 95 and the keyfob 13 may occur within the proximity preselected by the manufacturer and thus may be limited by design. For example, it may be desirable in PK systems not requiring vehicle user action for the proximity to be approximately 100 meters. Or, for example, it may be desirable in PK systems requiring one or more vehicle user actions for the proximity to be only 1-2 meters. Moreover, the range of the proximity may vary depending on system characteristics such as power of the transceivers, hardware implementation, filtering design at the transceivers, the medium of transmission, the path of transmission (e.g., where the path is uninhibited or comprised of obstacles), and any noise internal to the devices or environmental noise (i.e., noise within the medium of transmission).

In addition, all transmissions between the LF base-station 95 and keyfob 13 may be encrypted to further enhance security. Cryptography may include Advanced Encryption Standard (AES), a symmetric cryptographic algorithm, or Rivest, Shamir and Adleman (RSA), an asymmetric (or public key) cryptographic algorithm. It should be appreciated that the method described below may be used with any suitable type of passive keyless (PK) system, including any of aforementioned examples.

Method—

Figure 4:
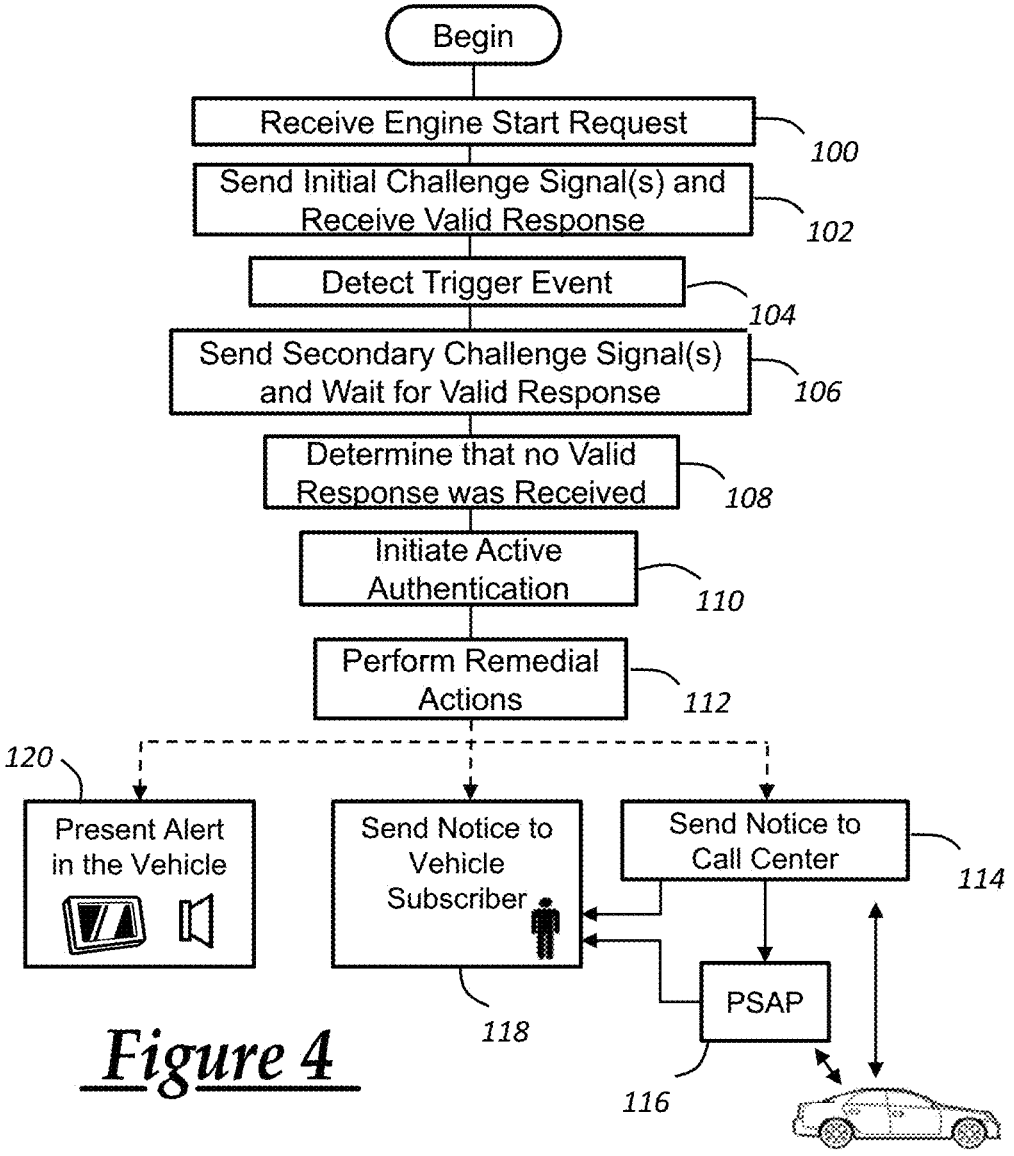
FIG. 4 is a flowchart illustrating an exemplary method for authenticating a vehicle equipped with a passive keyless system.

FIG. 4 illustrates one method of implementing the present disclosure. It shows a method for authenticating a driver of a vehicle equipped with a passive keyless system that includes a vehicle transceiver configured to communicate with a portable keyfob. The method may be used to detect and/or thwart an attempted relay attack.

In step 100, the method receives a request to start the vehicle. As previously discussed, the vehicle start request may be sent by the keyfob 13 to the base unit 49. In one implementation, the base unit 49 may first transmit a beacon signal that wakes up the keyfob 13, this typically occurs before the driver enters the vehicle. After it wakes up, the keyfob 13 may then send the request to start the vehicle. In response to this vehicle start request, the base unit 49 may send one or more initial challenge signal(s) to the keyfob 13 (step 102). Thus, the initial challenge signal(s) are sent in response to a passive keyless start attempt and are sent before the vehicle is actually started.

Upon receiving the initial challenge signal(s), the keyfob 13 may transmit an accurate or valid response signal back to the base unit 49, which would result in the vehicle starting (e.g., an engine would start in the case of a conventional non-hybrid vehicle or an electrical propulsion system would be enabled or activated for a hybrid vehicle). However, where the base unit 49 fails to receive a valid response signal or simply receives no response from the keyfob 13, the vehicle will not start. In one implementation, the vehicle may only start if one or more vehicle entrance indicators are detected in conjunction with the challenge signal and/or its accompanying valid response signal (i.e., keyfob presence validation). In another implementation, the vehicle may not start unless the entrance indicators are detected within a preselected amount of time of the initial challenge signal(s) and/or the valid response signal. The preselected amount of time may be determined by the manufacturer of the vehicle or the telematics unit or may be defined by a user (e.g., programmable). In one example, the preselected amount of time may be two minutes; e.g., once the base unit 49 challenge signal is responded to with a valid response from keyfob 13, the vehicle may not start unless the brake is depressed within two minutes.

As used herein, vehicle entrance indicators may include one or more user actions indicating that the driver has entered the vehicle and wishes to start the vehicle; e.g., opening the driver's door, depressing the brake pedal, actuating the passive keyless system start button, engaging the driver's seat belt, etc. These vehicle entrance indicators may be detected by the BCM 42 or some other VSM. These vehicle entrance indicators are illustrative and various other entrance indicators and/or combinations, series, or sequences of entrance indicators may be used. At this point in the exemplary method of FIG. 4, it is assumed that there has been a valid authentication, that the vehicle has been started, and that the driver is now driving the vehicle away from the location where it was previously located.

In step 104, the method detects a trigger event that causes it to require further authentication of the keyfob 13. The detected trigger event may pertain to movement of the vehicle and may be determined by the GPS 40, a VSM 42 such as the BCM, the telematics unit 30, or some other suitable device. For example, the GPS 40 may determine vehicle movement based upon the vehicle's geographical displacement (i.e., the distance the vehicle has traveled since it was last started) and/or the VSM 42 may detect vehicle movement by detecting vehicle wheel rotation or odometer increments. In one implementation, the method detects particular movement conditions referred to as moving vehicle trigger events. These trigger events include, but are not limited to: detecting when a vehicle odometer increments by a predefined amount and when an accumulation of the increments is less than a maximum threshold; when a distance delta acquired from the GPS module 40 is greater than a predefined GPS delta threshold and when the distance delta is less than a maximum GPS delta; and when a speed of the vehicle is greater than a minimum speed threshold, and when a timer value is less than a maximum timer value, to cite a few possibilities.

Upon receiving an indication that at least one trigger event has occurred, in step 106 one or more secondary challenge signal(s) may be sent from the base unit 49 to keyfob 13, e.g., to determine whether the keyfob is presently within the vehicle. The secondary challenge signal(s) are sent in response to the trigger event and after the vehicle is successfully started. If the keyfob 13 is still within the vehicle, it may respond accurately to the secondary challenge. However, if the keyfob is not within the vehicle, in step 108, the method will conclude that the secondary challenge has not been properly validated. In some instances, the absence of a valid response from the keyfob 13 may indicate the occurrence of a relay attack. In one implementation, the base unit 49 may wait to receive an accurate response to the secondary challenge signal(s) from the keyfob 13 for a predetermined amount of time, or for a predetermined number of attempts. If this predetermined amount of time or number of attempts lapses without a response, the response may be determined to be not valid. The secondary challenge may involve the same authentication techniques as the initial challenge, or it may involve others.

Figure 1:
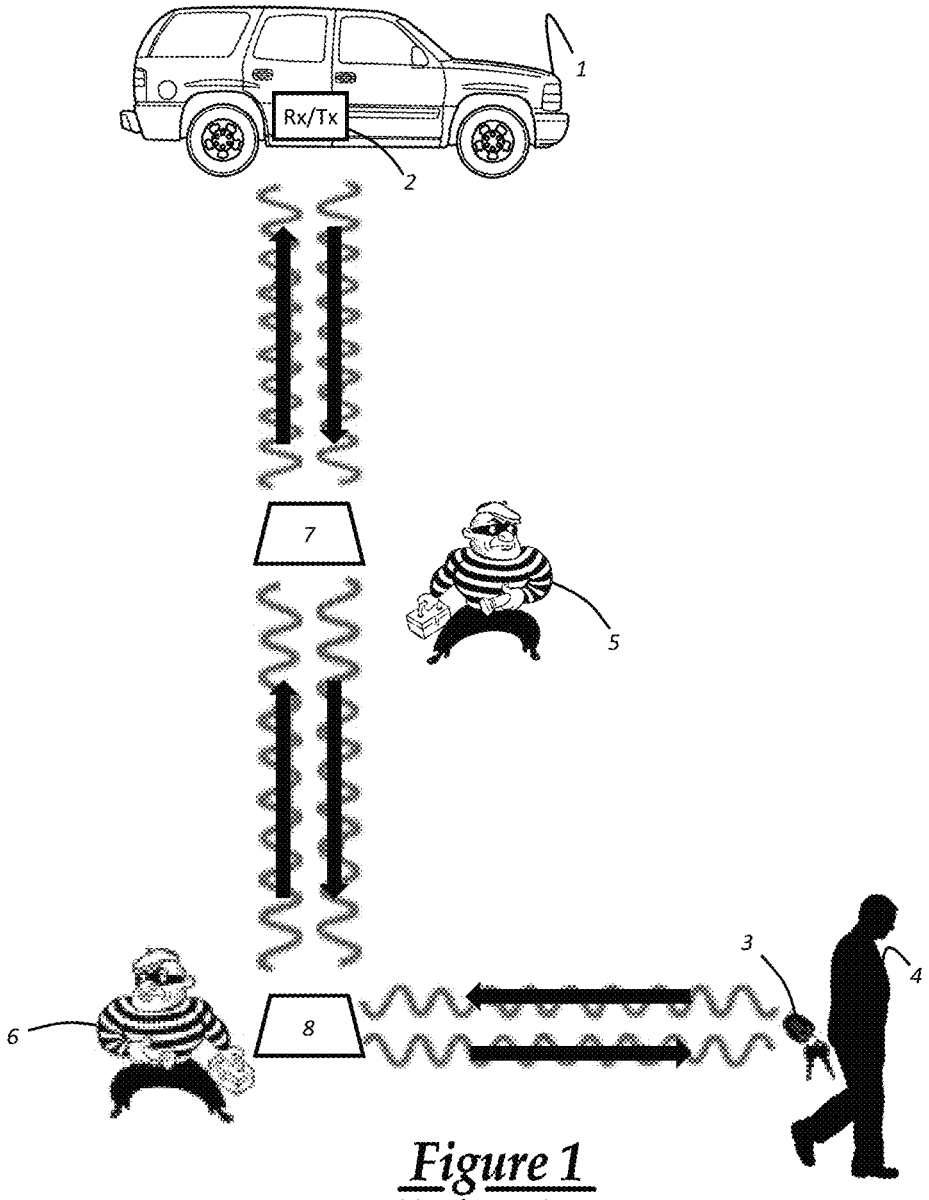
Figure 1 Prior Art
FIG. 1 is a block diagram of a relay attack on a vehicle equipped with a passive keyless entry and start system.

In the case of an attempted relay attack, like that described above in conjunction with FIG. 1, the thieves would most likely not be able to validly respond to the secondary challenge signal(s). To explain, as the thief 5 drives the stolen vehicle 1 away from the location where it was previously parked one or more portions of the viable ranges within the communication path would be exceeded, thus disrupting the ability to successfully authenticate. In one scenario, the vehicle transceiver 2 would no longer be in proximity to first repeater (FR) 7. Thus, a valid response signal to the secondary challenge signal(s) would not be obtained from the keyfob 3, which is still being carried by the actual owner or victim. If the thief 5 were to bring the FR 7 with him in the stolen vehicle so that a connection could continue to be made between the vehicle transceiver 2 and the FR 7, the second thief 6 would have to continue to stay within close proximity of the victim 4 so that a valid response signal could be obtained from the keyfob 3. Needless to say, this could prove to be difficult, particularly if the thieves were trying to remain inconspicuous and covert. Even in the case where thief 6 is able to maintain proximity to victim 4, driving the vehicle beyond the range supported by the communication between FR 7 and SR 8 would result in an inability to receive valid response signals from keyfob 13. In this illustration, step 108 would likely determine that no valid response to the secondary challenge signal(s) was received and the method would proceed to step 110, as explained below. This is one way in which the present system and method differ from conventional passive keyless systems that only use an initial challenge to start the vehicle, but do not employ a subsequent secondary challenge.

When the secondary challenge is not validated, step 110 may then initiate a separate active authentication to confirm the presence of an authorized driver in the vehicle. As understood by those skilled in the art, there may be some valid or legitimate reason, other than the vehicle being stolen, as to why the current driver does not have a keyfob that can adequately respond to the secondary challenge signal(s). One possibility is that an authorized driver in possession of a valid keyfob initially started the vehicle and drove some distance before exiting the vehicle and allowing a different authorized person to drive. If the initial driver were to forget to hand the keyfob 13 to the new driver before exiting the vehicle, the new driver would not be able to adequately respond to the secondary challenge and the method may incorrectly conclude that the vehicle was being stolen. Another possibility is for radio frequency signals from other devices to be present at a specific location and time which causes the keyfob 13 to not be appropriately detected. Thus, step 110 provides the driver with an opportunity to verify or otherwise establish that he or she is, in fact, an authorized driver before taking remedial actions, such as sending a report to the lawful owner of the vehicle. Step 110 may be carried out with the use of the telematics unit 30, the microphone 32, the audio system 36, the touch screen display 38, some other suitable module 42 within the vehicle, or a combination thereof.

According to one embodiment, the active authentication in step 110 includes posing a question or presenting a test to the driver in order to establish that they are authorized to drive the vehicle. For instance, step 110 may use a touch screen display 38, an automated voice processing unit with microphone 32 and/or any other suitable device to prompt the driver and ask for a valid pin or password, to ask for the answer to a predetermined security question, to ask for a selection of a predetermined image from a group of images, or any other type of test that demonstrates the driver is, in fact, authorized to drive the vehicle. In a different embodiment, active authentication occurs through the actuation of one of the physical buttons 97 on the keyfob 13. In a different embodiment, active authentication includes evaluating one or more biometrics of the driver in an effort to positively identify the driver and establish their authorization. To illustrate, step 110 may use one or more cameras around the interior of the vehicle to take images of the driver's face and, using known facial recognition techniques, verify their identification. Other biometric analysis, such as voice recognition using microphone 32, could be used as well. In yet another embodiment, active authentication involves confirmation from a previously registered or paired wireless device belonging to the owner of the vehicle or an authorized user, such as their smart phone, tablet, laptop, etc. For example, step 110 may instruct the telematics unit 30 and/or some other suitable device in the vehicle to send wireless signals seeking conformation from a previously registered or paired smart phone or tablet within the vehicle. If the driver is an authorized user and is in possession of a previously registered wireless device, then the device could respond with a verification of some type. In a different example, step 110 could alert the call center 20 to place a voice call or send a text message to one or more of the previously registered devices. If an acceptable answer is received within a certain amount of time, then the method may assume that the current driver is authorized; if an acceptable answer is not received within the set time period, the method may proceed to step 112 to carry out one or more remedial action(s).

It is possible for step 110 to utilize an active authentication that includes various combinations or sequences of the challenges or tests listed above. For instance, step 110 may start with a biometric test that includes a facial recognition or voice recognition analysis and, if that test fails, then pose a security question to the driver, and lastly attempt to obtain confirmation from the driver's wireless device. If the method aims to be as transparent and unobtrusive as possible, then it is possible for step 110 to begin by attempting to query the driver's wireless device and then, if such attempts fail, progress to a biometrics test followed by security questions and the like. If the method is satisfied that the driver is authorized (even though his or her keyfob did not provide a valid response to the secondary challenge signal(s) above), then the method may end. If, however, the method determines that the driver has not adequately responded to the active authentication, then the method may proceed to step 112.

In step 112 one or more remedial action(s) are performed. Remedial actions may include any type of suitable action taken by the method to address the possibility that the vehicle is being stolen. This can include, for example, simply sending warnings or notifications to the owner of the vehicle, some other previously registered user, the call center 20, a police department, etc., or taking more aggressive or affirmative steps like automatically bringing the car to a stop and disabling it. These remedial action(s) may be carried out using the telematics unit 30, some other module 42 or device within the vehicle, or a combination thereof. In one embodiment, the method sends a warning to the call center 20 (step 114), the vehicle owner (step 118), a third party public or private security service (step 116), an in-vehicle display 38, or some combination thereof. Of course, it is also possible for the vehicle notification to first be received by a Public Safety Answering Point (PSAP; also called a "Public Safety Access Point") (step 116) before being sent or relayed to the call center 20. Both the PSAP and the call center 20 may have the capability to identify the location of the vehicle 12. The notification may be a trouble code known to the call center 20 or a textual message, or it may take any other suitable form. Direct notifications may include a Short Message Service (SMS) text message or push notification sent via the carrier system 14 to the vehicle user's pre-registered wireless device (e.g., a cellular telephone, a personal digital assistant (PDA), a Smart Phone, a personal laptop computer having two-way communication capabilities, a netbook computer, etc.).

While FIG. 4 illustrates one embodiment, other embodiments are also possible. For example, the call center 20 may also further contact emergency services (including law enforcement) regarding the notification (e.g., if it is determined that the vehicle 12 has been stolen). Thus, the call center 20 may provide information to law enforcement to assist in the vehicle's recovery (e.g., the vehicle's whereabouts using GPS). Direct or indirect communication, and any variations thereof, may be preselected by the manufacturer and/or the vehicle owner (e.g., as a preference). In one embodiment, the vehicle owner may elect to both receive an SMS notification and have the telematics unit 30 send the notification to the call center 20. The particular selection of notification options may be made available to the vehicle owner via a telematics subscription account, such as via a web logon that permits subscriber configuration of these and other options.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method for authenticating a vehicle equipped with a passive keyless system that includes a vehicle module configured to communicate with a portable keyfob, the method comprising the steps of:

sending one or more initial challenge signal(s) from the vehicle module to the portable keyfob in response to a passive keyless start attempt of the vehicle, the initial challenge signal(s) being sent before a successful passive keyless start of the vehicle;

sending one or more secondary challenge signal(s) from the vehicle module to the portable keyfob after a successful passive keyless start of the vehicle and in response to a trigger event indicating that the vehicle has moved a particular distance from a location of the vehicle where the successful passive keyless start occurred, the secondary challenge signal(s) being sent to determine whether the portable keyfob is in the vehicle after the trigger event;

initiating an active authentication to confirm the presence of an authorized driver in the vehicle when a valid response to the secondary challenge signal(s) is not received by the vehicle module; and performing one or more remedial action(s) if a valid response to the active authentication is not received;

wherein the trigger event includes one or more of the following conditions:

a) a vehicle odometer increments by a predefined amount and an accumulation of the increments is less than a maximum threshold;

b) a distance delta acquired from a GPS module is greater than a predefined GPS delta threshold and the distance delta is less than a maximum GPS delta; or c) a speed of the vehicle is greater than a minimum speed threshold and a timer value is less than a maximum timer value.

2. The method of claim 1, wherein the secondary challenge signal(s) are repeated for a predetermined amount of time or for a predetermined number of attempts.

3. The method of claim 1, wherein the trigger event includes a vehicle odometer being incremented by a predefined amount.

4. The method of claim 1, wherein the trigger event includes a distance delta acquired from a GPS module being greater than a predefined distance delta threshold.

5. The method of claim 1, wherein the trigger event includes a speed of the vehicle being greater than a minimum speed threshold.

6. The method of claim 1, wherein the active authentication includes sending one or more request(s) for a valid active-response from an authorized driver and/or an authorized wireless device.

7. The method of claim 1, wherein the active authentication includes using an on-board vehicle display to prompt a vehicle driver to enter a valid pin or password, to answer a security question, to select a predetermined image from a group of images, or a combination thereof.

8. The method of claim 1, wherein the active authentication includes using an on-board camera or microphone to evaluate one or more biometric(s) of a vehicle driver using facial recognition, voice recognition, or a combination thereof.

9. The method of claim 1, wherein the active authentication includes using an on-board unit to automatically determine the presence of a previously authorized or a previously paired wireless device.

10. The method of claim 1, wherein active authentication includes using an on-board telematics unit to initiate a call to the vehicle and to prompt the vehicle driver to perform a validating action.

11. The method of claim 1, wherein active authentication includes receiving a wireless signal initiated by physical actuation of a user interface on a keyfob.

12. The method of claim 1, wherein the remedial action(s) include initiating GPS tracking of the vehicle, notifying a call center, notifying an authorized driver, initiating a vehicle slow down, or a combination thereof.

13. A method for authenticating a vehicle equipped with a passive keyless system that includes a vehicle module configured to communicate with a portable keyfob, the method comprising the steps of:

initiating passive authentication of the keyfob following a passive keyless start of the vehicle and in response to a trigger event that indicates that the vehicle has moved a particular distance from a location of the vehicle where the passive keyless start occurred;

determining if an authorized driver is present in the vehicle when a predetermined number of attempts to passively authenticate the keyfob have failed, wherein determining if an authorized driver is present includes sending one or more prompt(s) requiring a valid active-response from an authorized driver and/or an authorized wireless device; and performing one or more remedial action(s) if a valid active-response is not received;

wherein the trigger event includes one or more of the following conditions:

a) a vehicle odometer increments by a predefined amount and an accumulation of the increments is less than a maximum threshold;

b) a distance delta acquired from a GPS module is greater than a predefined GPS delta threshold and the distance delta is less than a maximum GPS delta; or c) a speed of the vehicle is greater than a minimum speed threshold and a timer value is less than a maximum timer value.

14. The method of claim 13, wherein determining if an authorized driver is present in the vehicle includes using an on-board vehicle display to prompt the vehicle driver to enter a valid pin or password, to answer a security question, to select a predetermined image from a group of images, or a combination thereof.

15. The method of claim 13, wherein determining if an authorized driver is present in the vehicle includes using an on-board camera or microphone to evaluate one or more biometric(s) of a vehicle driver using facial recognition, voice recognition, or a combination thereof.

16. The method of claim 13, wherein determining if an authorized driver is present in the vehicle includes using an on-board unit to automatically determine the presence of a previously authorized or a previously paired wireless device.

17. The method of claim 13, wherein determining if an authorized driver is present in the vehicle includes using an on-board telematics unit to initiate a call to the vehicle and to prompt the vehicle driver to perform a validating action.

18. A system for authenticating an authorized driver of a vehicle, the system comprising:

at least one vehicle system module configured to detect one or more moving vehicle trigger(s) indicating that the vehicle has moved a particular distance from a location of the vehicle where a passive keyless start occurred, wherein the one or more moving vehicle trigger(s) includes one or more of the following conditions:

a) a vehicle odometer increments by a predefined amount and an accumulation of the increments is less than a maximum threshold;

b) a distance delta acquired from a GPS module is greater than a predefined GPS delta threshold and the distance delta is less than a maximum GPS delta; or c) a speed of the vehicle is greater than a minimum speed threshold and a timer value is less than a maximum timer value; and a passive keyless start system including a vehicle module configured to wirelessly communicate with, and to passively authenticate, a portable keyfob in response to detecting at least one of the moving vehicle triggers, the passive keyless start system is configured to:

determine if an authorized driver is present in the vehicle when a predetermined number of attempts to passively authenticate the keyfob have failed, wherein determining the presence of the authorized driver includes sending one or more prompt(s) requiring a valid active-response from an authorized driver and/or an authorized wireless device; and initiate one or more remedial action(s) in response to determining that no authorized driver is present.

19. The system of claim 18, wherein determining if an authorized driver is present in the vehicle includes one or more of the following:

using an on-board unit to automatically detect the presence of a previously authorized or a previously paired wireless device;

using an on-board vehicle display to prompt the vehicle driver to enter a valid pin or password, to answer a security question, to select a predetermined image from a group of images, or a combination thereof;

using an on-board telematics unit to initiate a call to the vehicle and to prompt the vehicle driver to perform a validating action;

using an on-board camera or microphone to evaluate one or more biometric(s) of the vehicle driver using facial recognition, voice recognition, or a combination thereof; and using received indication of driver actuation of user interface commands on the keyfob.

* * * * *